US009777351B2

(12) United States Patent
Zou et al.

(10) Patent No.: US 9,777,351 B2
(45) Date of Patent: Oct. 3, 2017

(54) METHOD FOR HEAT TREATMENT OF HYPEREUTECTOID STEEL RAIL

(71) Applicant: PANGANG GROUP PANZHIHUA IRON & STEEL RESEARCH INSTITUTE CO., LTD., Panzhihua (CN)

(72) Inventors: Ming Zou, Panzhihua (CN); Zhenyu Han, Panzhihua (CN); Jihai Jia, Panzhihua (CN); Hua Guo, Panzhihua (CN); Yong Deng, Panzhihua (CN); Chunjian Wang, Panzhihua (CN); Jun Yuan, Panzhihua (CN); Hui Yao, Panzhihua (CN)

(73) Assignee: Pangang Group Panzhihua Iron & Steel Research Institute Co., Ltd., Panzhihua (CN)

( * ) Notice: Subject to any disclaimer, the term of this patent is extended or adjusted under 35 U.S.C. 154(b) by 359 days.

(21) Appl. No.: 14/583,075

(22) Filed: Dec. 24, 2014

(65) Prior Publication Data

US 2015/0232968 A1 Aug. 20, 2015

(30) Foreign Application Priority Data

Feb. 20, 2014 (CN) ..... 2014 1 0058292

(51) Int. Cl.

| | |
|---|---|
| ***C21D 9/04*** | (2006.01) |
| ***C21D 6/00*** | (2006.01) |
| ***C22C 38/24*** | (2006.01) |
| ***C21D 1/18*** | (2006.01) |
| ***C22C 38/02*** | (2006.01) |
| ***C22C 38/04*** | (2006.01) |
| ***C22C 38/18*** | (2006.01) |

(52) U.S. Cl.

CPC ..... *C22C 38/24* (2013.01); *C21D 1/18* (2013.01); *C21D 6/002* (2013.01); *C21D 6/005* (2013.01); *C21D 6/008* (2013.01); *C21D 9/04* (2013.01); *C22C 38/02* (2013.01); *C22C 38/04* (2013.01); *C22C 38/18* (2013.01); *C21D 2211/003* (2013.01); *C21D 2211/009* (2013.01)

(58) Field of Classification Search

None

See application file for complete search history.

(56) References Cited

FOREIGN PATENT DOCUMENTS

| | | | |
|---|---|---|---|
| CN | 101701284 | A | 5/2010 |
| CN | 101921950 | A | 12/2010 |

*Primary Examiner* — Deborah Yee

(74) *Attorney, Agent, or Firm* — Blakely, Sokoloff, Taylor & Zafman LLP

(57) ABSTRACT

The present invention discloses a method for heat treatment of hypereutectoid steel rail, including the following steps: holding the temperature of the steel rail of which temperature is above 900° C. after finish rolling, conducting a first cooling stage for the steel rail at the first cooling speed after the temperature holding to reduce the temperature of railhead surface layer of the steel rail to 700-750° C., conducting a second cooling stage for the steel rail at the second cooling speed to reduce the temperature of railhead surface layer of the steel rail to 550° C., conducting a third cooling stage for the steel rail at the third cooling speed to reduce the temperature of railhead surface layer of the steel rail to 450° C. or less, and continuing to cool the steel rail in the air. While obtaining good tensile property, the steel rail treated by the method for heat treatment provided by the present invention can effectively reduce secondary cementite and have excellent resistance to abrasion and contact fatigue. The product is particularly suitable for heavy rails.

5 Claims, No Drawings

METHOD FOR HEAT TREATMENT OF HYPEREUTECTOID STEEL RAIL

CROSS REFERENCE TO RELATED APPLICATION

This application claims priority to Chinese Application No. 201410058292.4, filed on Feb. 20, 2014, entitled "A Method for Heat Treatment of Hypereutectoid Steel Rail", which is specifically and entirely incorporated by reference.

FIELD OF THE INVENTION

The present invention relates to a method for heat treatment of hypereutectoid steel rail, particularly to a method, which can reduce the precipitation of secondary cementite for heat treatment of high-carbon hypereutectoid steel rail.

BACKGROUND OF THE INVENTION

At present, the steel rails widely used in railway mostly are made of eutectoid pearlitic steel, characterized by good match in strength and toughness, moderate performance indexes and as such. However, following the continuous increase of traffic density and axle load of freight trains, high requirements are set for the service performance of railway rails. The fast abrasion at the wheel-track contacting locations has gradually become a main factor affecting the service life of heavy rails, particularly the rails at the curves with a small radius. For this reason, the R&D personnel in this field have always been dedicated to developing new steel rail products with good abrasion resistance as well as good contact fatigue resistance and other comprehensive performance indexes to meet the need of railway construction.

The research discovers there are two methods which can meet all of the above requirements: one is to further raise the carbon content of steel rails, add an appropriate amount of alloying elements, give full play to the role of carbon in enhancing abrasion resistance of steel rails and provide better abrasion resistance and contact fatigue resistance for steel rails through a post-rolling cooling process; the second one is to use bainite steel rails with high alloy content, obtain bainite steel rails with good abrasion resistance also through controlling post-rolling cooling process and raise abrasion resistance while giving full scope to their contact fatigue resistance. As proved in practice, due to high alloying cost and a complex production process of bainite steel, the product is unstable in performance and does not possess the condition of mass popularization and application, while although high-carbon hypereutectoid steel rail can significantly improve the abrasion resistance of steel rail through raising carbon content of the steel rail, due to high carbon content, secondary cementite will be precipitated with priority on austenite grain boundary during continuous cooling of the steel rail with which the austenite forms pearlite after rolling and the secondary cementite is distributed in a net shape along the original austenite grain boundary. As the hard phase and strengthening phase of steel, the secondary cementite unquestionably raises hardness and abrasion resistance of the steel, but its adverse effect is non-negligible too: under the impact of wheel stress, it is liable that microcracks are formed at the cementite location and spread continuously along its net shape, finally result in peeling, chipping, oblique cracks and other fatigue damages at the contact locations and even induce rail breakage, imposing an extreme hidden danger to railway transport safety.

Reducing precipitation of secondary cementite in a method for heat treatment of high-carbon hypereutectoid steel rail is a key to the production of steel rails with excellent abrasion resistance and fatigue resistance. Therefore, it is in urgent need in this field to develop a method for heat treatment of high-carbon hypereutectoid steel rail, which can reduce precipitation of secondary cementite.

SUMMARY OF THE INVENTION

The object of the present invention is to provide a method for heat treatment of hypereutectoid steel rail, which ensures the steel rail after finish rolling can sufficiently refine pearlitic structure in rail steel and effectively reduce precipitation of secondary cementite.

In order to realize the above object, the present invention provides a method for heat treatment of hypereutectoid steel rail, comprising: holding the temperature of a steel rail with a temperature of above 900° C. after finish rolling, conducting a first cooling stage for the steel rail at a first cooling speed after the temperature holding to reduce the temperature of railhead surface layer of the steel rail to 700-750° C., conducting a second cooling stage for the steel rail at a second cooling speed to reduce the temperature of railhead surface layer of the steel rail to 550° C., conducting a third cooling stage for the steel rail at a third cooling speed to reduce the temperature of railhead surface layer of the steel rail to 450° C. or less, and continuing to naturally cool the steel rail in the air.

The method for heat treatment provided according to the present invention can sufficiently refine pearlitic structure in the steel, thus achieving a higher hardness index and good match in strength and toughness, and meanwhile can effectively reduce precipitation of secondary cementite in steel, make the average length of secondary cementite not exceed 10 μm, the ratio of secondary cementite not exceed 1% and secondary cementite evenly distributed along grain boundary and not form a closed net, and enable the steel rail to posses both excellent abrasion resistance and contact fatigue resistance.

Other features and advantages of the present invention will be described in details in the subsequent embodiments.

DETAILED DESCRIPTION OF THE EMBODIMENTS

The embodiments of the present invention are elaborated below. It should be understood that these embodiments are intended to describe and explain the present invention and not to limit the present invention.

The present invention provides a method for heat treatment of hypereutectoid steel rail, comprising: holding the temperature of a steel rail with a temperature of above 900° C. after finish rolling, conducting a first cooling stage for the steel rail at a first cooling speed after the temperature holding to reduce the temperature of railhead surface layer of the steel rail to 700-750° C., conducting a second cooling stage for the steel rail at a second cooling speed to reduce the temperature of railhead surface layer of the steel rail to 550° C., conducting a third cooling stage for the steel rail at a third cooling speed to reduce the temperature of railhead surface layer of the steel rail to 450° C. or less, and continuing to naturally cool the steel rail in the air.

The inventor of the present invention discovers in research that by holding temperature of high-temperature steel rail and cooling the steel rail at different cooling speeds in different stages especially through applying cooling medium, the pearlitic structure in steel rail can be sufficiently refined and the precipitation of secondary cementite can be effectively reduced. For example, the cooling medium is applied to the steel rail after temperature holding to conduct the first cooling stage at the first cooling speed, to reduce the temperature of rail surface layer to 700-750° C.; then the cooling medium is applied to conduct the second cooling stage at the second cooling speed, to reduce the temperature of rail surface layer to 550° C., as the content of carbon and other alloying elements in hypereutectoid steel is high, if the first cooling speed is still adopted in the second cooling stage, the railhead surface layer will be cooled too fast and abnormal structures might be generated, resulting in scrap of steel rail; then the cooling medium is applied to conduct the third cooling stage at the third cooling speed, to reduce the temperature of rail surface layer to 450° C. or less. After the temperature of the steel rail is reduced to 550° C., the pearlitic transformation of rail surface layer is completed, in order to ensure same high performance is obtained in the core of railhead, a certain cooling speed must be maintained until the pearlitic transformation in the whole section of the steel rail is completed.

According to the said method for heat treatment of hypereutectoid steel rail provided by the present invention, the steel rail after temperature holding is conducted to first cooling stage at the first cooling speed to reduce the temperature of railhead surface layer to 700-750° C. When the first cooling speed is less than 3.5° C./s, the observation of microscopic structure indicates the cementite is thin at the moment, but it is still arranged along the grain boundary in a net shape and cannot achieve the object of sufficiently inhibiting the precipitation of secondary cementite; while the first cooling speed is more than 5.0° C./s, as railhead surface layer is cooled fast and the core of the railhead is cooled slowly, the surface layer and core of the railhead cannot realize sufficient heat exchange, as a result that when the surface layer is close to, even enters the transformation area, the temperature of the core is still very high and the purpose of reducing precipitation of secondary cementite in the cross section of railhead cannot be realized, either. Preferably, the first cooling speed is 3.5-5.0° C./s. second cooling stage of the steel rail at the second cooling speed is conducted to reduce the temperature of railhead surface layer to 550° C. During the continuous cooling and transformation of the hypereutectoid steel rail, the phase-transition temperature for obtaining pearlitic structure is 600-650° C. As the content of carbon and other alloying elements in the hypereutectoid steel rail is high, if the first cooling speed is still maintained in the second cooling stage, the high cooling speed may result in generation of bainite, martensite and other abnormal structures and cannot assure the microstructure meets requirements, resulting in scrap of the steel rail. When the second cooling speed is less than 2.0° C./s, the cross section of railhead is unable to complete phase transformation at a high degree of supercooling and thus unable to obtain ideal performance indexes. Preferably, the second cooling speed is 2.0-3.0° C./s. The third cooling stage of the steel rail at the third cooling speed is conducted to reduce the temperature of railhead surface layer to 450° C. or less. After the temperature of railhead surface layer is below 550° C., the pearlitic transformation of railhead surface layer is completed. As verified by the inventor in experiments, in order to ensure same high performance is obtained in the core of the railhead, a certain cooling speed must be maintained. Besides, in order to avoid unnecessary energy consumption and waste resulting from high cooling speed, preferably the third cooling speed is 1.0-1.5° C./s. When the temperature of railhead surface layer of the steel rail is reduced to 450° C. or less, the pearlitic transformation in the whole section of the steel rail is completed. By now, in order to avoid energy consumption, no cooling medium is needed and it may be cooled naturally in the air.

In the present invention, there are no special requirements for the conducting manner of cooling, the conventional methods in the field may be adopted. For example, the method can include applying cooling medium on the top surface and two side surfaces of the railhead of the steel rail.

In the present invention, the cooling medium may be cooling medium conventionally used in the field, which can be compressed air or water mist mixed gas for example.

For the steel rail after finish rolling, the carbon distribution in the steel is uneven. Particularly in the part with large rolling deformation, there exists serious carbon segregation. As carbon diffuses fast in austenized steel, the inventor of the present invention discovers during research this problem can be solved by holding temperature of the steel rail to lengthen the time of austenization. The temperature holding may include putting the steel rail of above 900° C. on a roller table and holding the temperature after rolling. The inventor of the present invention discovers during research that minimum 30s' temperature holding may achieve the effect of homogenization, in other words, the time of temperature holding may be longer than 30s. When the time of temperature holding is lengthened to 50s, the carbon in the steel rail has thoroughly diffused and achieved the effect of homogenization. Considering production efficiency and other factors, the preferred time of temperature holding is 30-50s.

In the present invention, the heating device for temperature holding of steel rail may be a heating device conventionally used in the field. For example, it may be a medium-frequency induction device, a line-frequency induction device or a U-shaped resistance heating furnace.

In the present invention, in order that the steel rail has better abrasion resistance as well as good contact fatigue resistance and other performance indexes to meet the needs of railway construction, the steel rail with high carbon content may be selected. Preferably, the carbon content of the steel rail is above 0.90 wt. %.

In an embodiment, the method for heat treatment of hypereutectoid steel rail, which can reduce precipitation of secondary cementite may be: using a tilting stand to erect the steel rail on a roller table after finish rolling and adopting a medium-frequency induction device to hold the temperature of the steel rail for 30-50s; after temperature holding, applying cooling medium (water mist mixed gas) on the top surface and two side surface of the railhead of the steel rail to conduct a first cooling stage for the steel rail at the first cooling speed of 3.5-5.0° C./s to reduce the temperature of railhead surface layer to 700-750° C.; then conducting a second cooling stage for the steel rail at the second cooling speed of 2.0-3.0° C./s to reduce the temperature of railhead surface layer to 550° C.; then conducting a third cooling stage for the steel rail at the third cooling speed of 1.0-1.5° C./s to reduce the temperature of railhead surface layer to 450° C. or less; then continuing to naturally cool the steel rail in the air till arriving room temperature. After that, subsequent process steps may be started till obtaining a finished steel rail product.

EXAMPLES

Below the present invention is described in connection with embodiments, but it is not limited to them.

Examples 1-6 select the hypereutectoid steel rail with chemical composition in the following reference numbers 1-6 as well as comparative examples 1-6. The concrete chemical composition is shown in Table 1.

TABLE 1

| | Chemical composition/wt. % | | | | | | |
|---|---|---|---|---|---|---|---|
| No. | C | Si | Mn | P | S | Cr | V |
| 1 | 0.92 | 0.56 | 0.82 | 0.014 | 0.006 | 0.15 | 0.03 |
| 2 | 0.94 | 0.78 | 0.80 | 0.015 | 0.008 | 0.28 | 0.05 |
| 3 | 0.97 | 0.69 | 0.74 | 0.010 | 0.005 | 0.42 | 0.05 |
| 4 | 0.91 | 0.75 | 0.76 | 0.012 | 0.009 | 0.25 | 0.04 |
| 5 | 1.03 | 0.52 | 0.91 | 0.012 | 0.008 | 0.19 | — |
| 6 | 1.05 | 0.39 | 0.81 | 0.011 | 0.006 | 0.08 | — |

Example 1

The billet with No. 1 chemical composition as shown in Table 1 is rolled into 60 kg/m steel rail. The temperature of finish rolling is 925° C. After finish rolling, the steel rail is erected on a roller table with the help of a tilting stand. The temperature of the steel rail is held by a medium frequency induction device for 35s. After temperature holding, the initial cooling temperature before the first cooling stage cooling is 916° C., and the cooling medium is water mist mixed gas applied on the top surface and two side surfaces of the railhead of the steel rail. Conduct the first cooling stage cooling for the steel rail at the first cooling speed of 4.2° C./s to reduce the temperature of railhead surface layer of the steel rail to 724° C.; then a second cooling stage for the steel rail is conducted at the second cooling speed of 2.5° C./s to reduce the temperature of railhead surface layer to 550° C.; then a third cooling stage for the steel rail is conducted at the third cooling speed of 1.2° C./s to reduce the temperature of railhead surface layer to 448° C.; then the steel rail is cooled naturally in the air continuously to room temperature. By now the subsequent process steps may be started and finally steel rail A1 is obtained.

Examples 2-6 and Comparative Example 1-6

Examples 2-6 adopt the method of Embodiment 1, but their operating conditions are different from those of example 1, but as the concrete operating conditions shown in Table 2. The steel rails produced by examples 2-6 are A2-A6. Comparative examples 1-6 adopt the current existing steel rail method for heat treatment (i.e. the cooling process has only one stage, that is adopting the constant cooling speed to cool the steel rail after finish rolling to room temperature), as the concrete operating conditions shown in Table 2. The steel rails produced by the method of comparative examples 1-6 are D1-D6.

Test Example

The performance of steel rails A1-A6 and D1-D6 produced in examples 1-6 and comparative examples 1-6 is tested by the following method. To be specific:

The tensile property of steel rails is determined according to China Standard No. GB/T228-2010 titled *Test Methods for Tension Testing of Metallic Materials*. The obtained $R_{p0.2}$ (stress when non-proportional elongation is 0.2%), $R_m$ (tensile strength), A % (elongation) and Z % (reduction of area) are as shown in Table 3.

The microstructure of steel rails is determined by MeF3 optical microscope according to China Standard No. GB/T 13298-1991 titled *Metal-Inspection Method of Microstructure*. The determined average length of secondary cementite is as shown in Table 3. The ratio of secondary cementite is calculated, and the result is as shown in Table 3.

Abrasion test is done on an MM-200 abrasion tester to detect average mass loss on abrasion. The samples are taken from the railheads of steel rails A1-A6 and D1-D6. In all the abrasion tests, the under-grinding samples are of a same material. The concrete test parameters are as follows:

Dimensions of the samples: 10 mm thick Φ36 mm round samples

Test load: 150 kg

Slip: 10%

Material of opposite under-grinding samples: U75V hot-rolled steel rail with hardness of 280-310 HB. The hardness is equivalent to the hardness of train wheels.

Environment: In the air.

Speed of rotation: 200 rpm

Total abrasion times: 200,000 times.

Determined average mass loss on abrasion is as shown in Table 3.

TABLE 2

| Item | No. | Finish rolling temp./° C. | Time of temp. holding/s | First stage initial starting temp./° C. | First cooling speed (° C./s) | First stage finish cooling temp./° C. | Second cooling speed (° C./s) | Second stage finish cooling temp./° C. | Third cooling speed (° C./s) | Third stage finish cooling temp./° C. |
|---|---|---|---|---|---|---|---|---|---|---|
| Example | 1 | 925 | 35 | 916 | 4.2 | 724 | 2.5 | 550 | 1.2 | 448 |
| | 2 | 932 | 30 | 925 | 3.8 | 716 | 2.0 | 550 | 1.0 | 442 |
| | 3 | 920 | 36 | 908 | 3.5 | 750 | 3.0 | 550 | 1.3 | 439 |
| | 4 | 914 | 44 | 906 | 3.9 | 732 | 2.6 | 550 | 1.2 | 449 |
| | 5 | 916 | 48 | 904 | 5.0 | 701 | 2.2 | 550 | 1.5 | 445 |
| | 6 | 975 | 50 | 958 | 4.8 | 722 | 2.8 | 550 | 1.2 | 442 |

| | No. | Finish rolling temp./° C. | The constant cooling speed (° C./s) |
|---|---|---|---|
| Comparative example | 1 | 930 | 2.5 |
| | 2 | 935 | 2.0 |
| | 3 | 922 | 3.0 |
| | 4 | 917 | 2.6 |
| | 5 | 915 | 2.2 |
| | 6 | 968 | 2.8 |

TABLE 3

| Item | Steel rail | Tensile property $R_{p0.2}$/MPa | $R_m$/MPa | A/% | Z/% | Average length of secondary cementite/ μm | Ratio of secondary cementite/ % | Average mass loss on abrasion/g |
|---|---|---|---|---|---|---|---|---|
| Example | A1 | 1105 | 1390 | 12.0 | 28.0 | 6.5 | 1.0 | 0.3865 |
| | A2 | 1120 | 1420 | 11.5 | 26.5 | 7.2 | 0.9 | 0.4126 |
| | A3 | 1145 | 1450 | 10.5 | 29.0 | 7.9 | 0.9 | 0.3703 |
| | A4 | 1075 | 1360 | 12.0 | 32.0 | 5.8 | 0.8 | 0.4658 |
| | A5 | 1155 | 1440 | 10.5 | 30.0 | 7.7 | 0.8 | 0.4012 |
| | A6 | 1180 | 1470 | 10.0 | 28.5 | 8.2 | 0.7 | 0.3658 |
| Comparative example | D1 | 1095 | 1380 | 11.5 | 28.0 | 9.4 | 2.3 | 0.5236 |
| | D2 | 1105 | 1400 | 11.0 | 26.5 | 10.6 | 1.7 | 0.4623 |
| | D3 | 1150 | 1440 | 10.0 | 29.0 | 10.2 | 1.8 | 0.4215 |
| | D4 | 1065 | 1370 | 11.0 | 32.0 | 8.6 | 2.5 | 0.5487 |
| | D5 | 1140 | 1430 | 10.0 | 30.0 | 10.4 | 1.7 | 0.4329 |
| | D6 | 1170 | 1450 | 10.0 | 28.5 | 11.3 | 1.6 | 0.4232 |

Examples 1-6 indicate the steel rails treated by the method for heat treatment provided by the present invention have good tensile property indexes, the average length of secondary cementite does not exceed 10 μm, the ratio of secondary cementite does not exceed 1% and the steel rails have excellent abrasion resistance and contact fatigue resistance.

By comparing examples 1-6 and comparative examples 1-6 respectively, it indicates that the length of secondary cementite and the ratio of secondary cementite of the hypereutectoid steel rails obtained after treatment by the method provided by the present invention are reduced obviously and the abrasion resistance and contact fatigue resistance are desirable.

To sum up, the steel rail obtained by the method for heat treatment of hypereutectoid steel provided by the present invention has good tensile property and can effectively reduce secondary cementite, thus possessing excellent abrasion resistance and contact fatigue resistance. The product is particularly suitable for heavy rails.

Above the preferred embodiments of the present invention are described in details, but the present invention is not limited to the details of the foregoing embodiments. In the range of technical approach of the present invention, the technical scheme of the present invention may be modified in various simple ways. These simple modifications all shall be within the scope of protection of the present invention.

In addition, it needs to be noted that the technical features described in the foregoing embodiments may be combined in any appropriate way as long as the combination is reconcilable. In order to avoid unnecessary repetition, the present invention does not explain the possible ways of combination.

Further, the embodiments of the present invention may be freely combined as long as the combination does go against the thought of the present invention. Likewise, they shall also be deemed as content disclosed by the present invention.

What is claimed is:

1. A method for heat treatment of a hypereutectoid steel rail, comprising:

heating and holding a steel rail at a temperature above 900° C. after hot rolling;

conducting a first cooling stage for the steel rail at a first cooling rate of 3.5-5.0° C./s after temperature holding to reduce the temperature of a railhead surface layer of the steel rail to 700-750° C.;

conducting a second cooling stage for the steel rail at a second cooling rate of 2.0-3.0° C./s to reduce the temperature of the railhead surface layer of the steel rail to 550° C.;

conducting a third cooling stage for the steel rail at a third cooling rate of 1.0-1.5° C./s to reduce the temperature of the railhead surface layer of the steel rail to 450° C. or less; and continuing to naturally cool the steel rail in the air.

2. The method according to claim 1, wherein conducting cooling of the steel rail at one or more of the cooling stages comprises:

applying a cooling medium on a top surface and two side surfaces of the railhead of the steel rail.

3. The method according to claim 2, wherein the cooling medium is compressed air or water mist mixed with gas.

4. The method according to claim 1, wherein holding the temperature of the steel rail comprises:

putting the steel rail above 900° C. on a roller table and holding the temperature for 30-50s after finish rolling.

5. The method according to claim 1, wherein a carbon content of the steel rail is above 0.90 wt. %.

* * * * *